US011028507B2

(12) United States Patent
Vanderjeugt et al.

(10) Patent No.: US 11,028,507 B2
(45) Date of Patent: Jun. 8, 2021

(54) FABRIC, IN PARTICULAR CARPET, AND METHOD OF WEAVING A FABRIC

(71) Applicant: Vandewiele NV, Kortrijk/Marke (BE)

(72) Inventors: Bram Vanderjeugt, Ypres (BE); Ludo Smissaert, Assebroek (BE); Steven Debaes, Rekkem (BE)

(73) Assignee: Vandewiele NV, Kortrijk/Marke (BE)

( * ) Notice: Subject to any disclaimer, the term of this patent is extended or adjusted under 35 U.S.C. 154(b) by 171 days.

(21) Appl. No.: 16/064,527

(22) PCT Filed: Jan. 5, 2017

(86) PCT No.: PCT/EP2017/050170

§ 371 (c)(1),
(2) Date: Jun. 21, 2018

(87) PCT Pub. No.: WO2017/121673

PCT Pub. Date: Jul. 20, 2017

(65) Prior Publication Data

US 2019/0010636 A1 Jan. 10, 2019

(30) Foreign Application Priority Data

Jan. 15, 2016 (EP) ..... 16151396

(51) Int. Cl.
*D03D 27/10* (2006.01)
*D03D 13/00* (2006.01)
*D03D 27/06* (2006.01)

(52) U.S. Cl.
CPC ..... *D03D 27/10* (2013.01); *D03D 13/004* (2013.01); *D03D 27/06* (2013.01); *D10B 2503/04* (2013.01)

(58) Field of Classification Search
CPC ..... D03D 1/00; D03D 1/0017; D03D 3/00; D03D 39/00; D03D 39/02; D03D 39/04; D03D 39/08; D03D 39/10; D03D 39/12; D03D 39/16; D03D 39/18; D03D 39/20; D03D 39/22; D03D 2700/50–60;
(Continued)

(56) References Cited

FOREIGN PATENT DOCUMENTS

| | | |
|---|---|---|
| CN | 104775223 | 7/2015 |
| EP | 2 894 244 | 7/2015 |
| WO | 2013041938 | 3/2013 |

OTHER PUBLICATIONS

Chinese Search Report of Chinese application No. 2017800051490, dated Aug. 22, 2019; 3 pages.

(Continued)

*Primary Examiner* — Camie S Thompson
(74) *Attorney, Agent, or Firm* — Rankin, Hill & Clark LLP

(57) ABSTRACT

A fabric (e.g., carpet having a shadow effect) includes a backing fabric having binding warp yarns repeatedly crossing each other for providing weft receiving openings, tension warp yarns substantially extending in a warp direction, and weft yarns substantially extending in a weft direction through the weft receiving openings, pile warp yarns interlaced with weft yarns for providing piles extending out of the backing fabric, wherein, at least one weft yarn is positioned immediately adjacent to one of the crossings of the binding warp yarns provides an end weft yarn positioned at a back side relative to at least one weft separating warp yarn extending in the backing fabric substantially in the warp direction, and at least one intermediate weft yarn positioned adjacent to such an end weft yarn in the warp direction is positioned at the pile side.

20 Claims, 3 Drawing Sheets

(58) Field of Classification Search
CPC ..... D03D 27/00–16; D03D 27/60; D03D 13/004; D03D 27/02; D03D 27/04; D03D 27/06; D03D 27/12; D03D 27/10; D10B 2503/04; D10B 2503/041
USPC ..... 139/116.5, 21, 37, 404, 391, 392; 428/85, 91, 92, 95, 88
See application file for complete search history.

(56) References Cited

OTHER PUBLICATIONS

Written Opinion arid International Search Report of PCT/EP2017/050170, dated May 4, 2017; 9 pages.
Extended European Search Report of 16151396.5, dated Jul. 8, 2016; 7 pages.

FABRIC, IN PARTICULAR CARPET, AND METHOD OF WEAVING A FABRIC

The present invention relates to a fabric, for example, a carpet, having a shadow effect. The invention further relates to a method of weaving a fabric, for example, a carpet, having a shadow effect.

From WO 2014/108228 A1 it is known that for providing a shadow effect at the pile side of a fabric, for example, a carpet, the piles provided by pile warp yarns are to be interlaced with weft yarns of a backing fabric such as to extend inclined relative to a direction that is perpendicular with respect to a plane defined by the warp direction and the weft direction. Depending on the direction of inclination of the piles and the viewing angle the surface of a fabric appears to be either a little bit darker or brighter.

It is an object of the present invention to provide a fabric, in particular a carpet, having a shadow effect and a method of weaving a fabric, in particular a carpet, having a shadow effect in which there is no need for moving tension warp yarns by means of a jacquard machine.

According to a first aspect of the present invention, this object is achieved by a fabric, in particular a carpet, having a shadow effect, comprising:

backing fabric having binding warp yarns repeatedly crossing each other for providing weft receiving openings, tension warp yarns substantially extending in a warp direction, and weft yarns substantially extending in a weft direction through the weft receiving openings, pile warp yarns interlaced with weft yarns of the backing fabric for providing piles extending out of the backing fabric at a pile side, wherein, in at least one weft receiving opening, preferably the majority of the weft receiving openings, most preferably each weft receiving opening, at least one weft yarn positioned immediately adjacent to one of the crossings of the binding warp yarns defining this weft receiving opening in the warp direction, preferably each one of the two weft yarns positioned immediately adjacent to the two crossings of the binding warp yarns defining this weft receiving opening in the warp direction, provides an end weft yarn positioned at a back side relative to at least one weft separating warp yarn extending in the backing fabric substantially in the warp direction, and at least one intermediate weft yarn adjacent to such an end weft yarn in the warp direction is positioned at the pile side relative to the at least one weft separating warp yarn, wherein, for providing a pile, in association with this weft receiving opening, a pile warp yarn is interlaced with an end weft yarn of this weft receiving opening such as to extend out of the backing fabric between this end weft yarn and an intermediate weft yarn of this weft receiving opening.

Due to providing the weft yarns between which piles extend out of the backing fabric at the pile side offset with respect to each other in the direction that is perpendicular with respect to a plane defined by the warp direction and the weft direction, a clear shadow effect can be obtained without the need for moving the tension warp yarns by means of a jacquard machine due to a quite simple and preferably constant ground weave of the backing fabric throughout at least a major portion of the fabric. For forming the sheds, the tension warp yarns may be moved by the same means as used for moving the other yarns of the backing fabric.

It is to be noted that, in the sense of the present application the expression "the majority of" means at least 50% of a particular structural element is provided in a particular manner.

In the fabric of the present invention, at least one pile may comprise two pile legs, one of the pile legs extending out of the backing fabric between the end weft yarn and the intermediate weft yarn and the other pile leg extending out of the backing fabric between the end weft yarn and an end weft yarn of an immediately adjacent weft receiving opening. In an alternative arrangement, at least one pile may comprise a single pile leg extending out of the backing fabric between the end weft yarn and the intermediate weft yarn or at least one pile may comprise a single pile leg extending out of the backing fabric between the end weft yarn and an end weft yarn of an immediately adjacent weft receiving opening.

For providing different shadow effects on the surface of a fabric, in association with at least one weft receiving opening, a pile may be provided by interlacing a pile warp yarn with an end weft yarn of this weft receiving opening positioned immediately adjacent to the crossing of the binding warp yarns defining this weft receiving opening in a first orientation of the warp direction and, in association with at least one other weft receiving opening, a pile may be provided by interlacing a pile warp yarn with an end weft yarn of this weft receiving opening positioned immediately adjacent to the crossing of the binding warp yarns defining this weft receiving opening in a second orientation of the warp direction, and/or in association with at least one weft receiving opening, preferably the majority of the weft receiving openings (O), most preferably each weft receiving opening, only one pile may be provided. Such a single pile may have one or two pile legs.

With such an arrangement, the piles will have different inclinations with respect to the surface of the fabric. In such a weaving structure, the selection of the direction of inclination of a respective pile is made by selecting an end weft yarn and the position of an end weft yarn within a weft receiving opening, respectively, for interlacing with a pile warp yarn. Therefore, there is no need for introducing a change of the ground weave of the backing fabric for allowing the changing of the direction of inclination of the piles. Depending on the desired pattern of the fabric the necessary direction of inclination of the piles in different areas of the fabric, is determined and correspondingly the positions of the end weft yarns within the weft receiving openings either at the one end or the other end in the warp direction are selected for interlacing with the pile warp yarns.

For providing a more emphasized shadow effect by increasing the offset of the weft yarns between which a pile extends out of the backing fabric, it is proposed that pile warp yarns not used for forming piles are bound into the backing fabric such as to extend substantially in the warp direction as dead pile warp yarns, and that at least one, preferably each intermediate weft yarn of at least one weft receiving opening is separated from both end weft yarns of this weft receiving opening by at least one tension warp yarn and at least one, preferably all the dead pile warp yarns extending in the area of this weft receiving opening.

In an alternative arrangement, pile warp yarns not used for forming piles may be bound into the backing fabric such as to extend substantially in the warp direction as dead pile warp yarns, and at least one, preferably each intermediate weft yarn of at least one weft receiving opening may be separated from a first one of the two end weft yarns of this weft receiving opening only by at least one tension warp yarn and may be separated from the second one of the two end weft yarns of this weft receiving opening by at least one tension warp yarn and at least one, preferably all the dead pile warp yarns extending in the area of this weft receiving opening. For using the increased offset of the weft yarns between which a pile extends out of the backing fabric in this arrangement, preferably in association with this weft receiving opening, a pile is formed by interlacing a pile warp yarn with the second one of the two end weft yarns of this weft receiving opening. The first one of the two end weft yarns of this weft receiving opening may be arranged on the pile side relative to the dead pile warp yarns extending in the area of this weft receiving opening and the second one of the two end weft yarns of this weft receiving opening may be arranged on the back side relative to the dead pile warp yarns extending in the area of this weft receiving opening.

For providing a fabric with a high density of piles, it is proposed that through at least one weft receiving opening, preferably the majority of the weft receiving openings, most preferably each weft receiving opening, at least three weft yarns, preferably exactly three weft yarns, extend. These three weft yarns may comprise two weft yarns providing the two end weft yarns and one intermediate weft yarn extending substantially in the weft direction. This means that only three weft yarns, what means exactly three weft yarns, extending through such weft receiving openings are needed for providing one pile. However, there may be weft receiving openings through which more than three weft yarns extend.

In the fabric of the present invention, a plurality of warp yarn systems may be provided following each other in the weft direction, at least one warp yarn system, preferably the majority of warp yarn systems, most preferably each warp yarn system, comprising two binding warp yarns crossing each other, at least one tension warp yarn, and at least one, preferably a plurality of pile warp yarns, wherein in the pile warp yarn systems piles are provided by the pile warp yarns of a respective pile warp yarn system by interlacing these pile warp yarns with weft yarns extending through the weft receiving openings provided by the binding warp yarns of the same pile warp yarn system, preferably such that, by means of the pile warp yarns of each one of the warp yarn systems, one row of piles substantially extending in the warp direction is provided. In such an arrangement, binding warp yarns extending in the warp direction in close proximity to each other in the weft direction are used for forming weft receiving openings and the pile warp yarns are interlaced with weft yarns extending through such weft receiving openings, while at the same time warp yarns of such a warp yarn system are used as weft separating warp yarns generating the offset of the intermediate weft yarns with respect to the end weft yarns. This leads to a defined positioning of the weft yarns in the direction perpendicular with respect to the plane defined by the weft direction and the warp direction, and leads to a defined positioning of the weft yarns in the warp direction in the region of each weft receiving opening. Such a defined positioning of the weft yarns in turn leads to a defined positioning of the piles extending out of the backing fabric and therefore leads to a clear shadow effect on the surface of such a fabric.

For ensuring a sufficient offset of those weft yarns which are positioned immediately adjacent to the two crossings defining a respective weft receiving opening, which weft yarns, for example, may be the two end weft yarns provided in a respective weft receiving opening, relative to the at least one intermediate weft yarn in at least one weft receiving opening, preferably the majority of these weft receiving openings, most preferably each weft receiving opening, the two weft yarns positioned immediately adjacent to the two crossings of the binding warp yarns defining this weft receiving opening are not separated by a tension warp yarn.

According to a further advantageous aspect of the present invention, throughout the major portion of the fabric, preferably throughout the entire fabric, the ground weave of the backing fabric provided by the binding warp yarns, the tension warp yarns, and the weft yarns is the same. This means that, in this portion of the fabric or in the entire fabric, the relative positioning of the weft yarns extending through respective weft receiving openings in particular with respect to the tension warp yarns is the same. Further the crossings of the binding warp yarns defining the weft receiving openings in the two orientations of the warp direction may be located at the same position in the warp direction.

According to a further aspect of the present invention, the object is achieved by a method of weaving a fabric, in particular a carpet, having a shadow effect, preferably a fabric according to the present invention, wherein for weaving a backing fabric binding warp yarns are provided crossing each other for providing weft receiving openings, such that each weft receiving opening is defined in the warp direction by two crossings of binding warp yarns, wherein tension warp yarns are provided extending substantially in the warp direction and in association with at least one weft receiving opening, preferably the majority of weft receiving openings, most preferably each weft receiving opening, weft yarns are provided extending through this weft receiving opening substantially in the weft direction, such that the weft yarns positioned immediately adjacent to the two crossings defining this weft receiving opening in the warp direction are provided as end weft yarns positioned at a back side relative to at least one weft separating warp yarn, and at least one intermediate weft yarn positioned substantially between the two end weft yarns in the warp direction is positioned at a pile side relative to the at least one weft separating warp yarn, wherein, in association with this weft receiving opening, a pile is generated by interlacing a pile warp yarn with one of the end weft yarns of this weft receiving opening such as to extend out of the backing fabric at the pile side between this end weft yarn and an intermediate weft yarn of this weft receiving opening.

When carrying out this method, pile warp yarns not used for forming piles may be bound into the backing fabric such as to extend substantially in the warp direction as dead pile warp yarns, and at least one, preferably each intermediate weft yarn of at least one weft receiving opening may be separated from both end weft yarns of this weft receiving opening by at least one tension warp yarn and at least one, preferably all the dead pile yarns extending in the area of this weft receiving opening.

Alternatively pile warp yarns not used for forming piles may be bound into the backing fabric such as to extend substantially in the warp direction as dead pile warp yarns, and at least one, preferably each intermediate weft yarn of at least one weft receiving opening may be separated from a first one of the two end weft yarns of this weft receiving opening only by at least one tension warp yarn and may be separated from the second one of the two end weft yarns of this weft receiving opening by at least one tension warp yarn and at least one, preferably all of the dead pile yarns extending in the area of this weft receiving opening. In association with this weft receiving opening, a pile may be formed by interlacing a pile warp yarn with the second one of the two end weft yarns of this weft receiving opening, and/or preferably wherein the first one of the two end weft yarns of this weft receiving opening is arranged on the pile side relative to the dead pile warp yarns extending in the area of this weft receiving opening and the second one of the two end weft yarns of this weft receiving opening is arranged on the back side relative to the dead pile warp yarns extending in the area of this weft receiving opening.

In association with each fabric to be woven, a plurality of warp yarn systems may be provided following each other in the weft direction, at least one warp yarn system, preferably the majority of warp yarn systems, most preferably each warp yarn system, comprising two binding warp yarns crossing each other, at least one tension warp yarn, and at least one, preferably a plurality of pile warp yarns, wherein in the pile warp yarn systems piles are provided by the pile warp yarns of a respective pile warp yarn system by interlacing these pile warp yarns with weft yarns extending through the weft receiving openings provided by the binding warp yarns of the same pile warp yarn system, preferably such that, by means of the pile warp yarns of each one of the warp yarn systems, one row of piles substantially extending in the warp direction is provided. In association with at least one, preferably each reed dent of a weaving machine, at least one warp yarn system may be provided. By providing a defined association of the warp yarn systems with the reed dents, a defined positioning of the weft yarns provided such as to extend through respective weft receiving openings generated by the crossing binding warp yarns of the warp yarn systems is obtained.

For increasing the output of a weaving machine, the method may be a face-to-face weaving method for simultaneously weaving two fabrics.

For providing the same number of pile rows in each one of the two fabrics to be woven, at least one, preferably each warp yarn system may comprise the warp yarns for both fabrics to be woven.

In the method of the present invention, in association with at least one warp yarn system, the crossings of the binding warp yarns of one of the two fabrics to be woven may be offset relative to the crossings of the binding warp yarns of the other one of the fabrics to be woven in the warp direction. In this way, the same direction of inclination of the piles provided in the two fabrics can be obtained. Further in at least one of the fabrics the crossings of the binding warp yarns defining the weft receiving openings in the two orientations of the warp direction are located at the same position in the warp direction, which may also be the case if, with the method of the present invention, only a single fabric is to be woven.

The present invention will now be explained with respect to the drawings in which.

Figure 1:
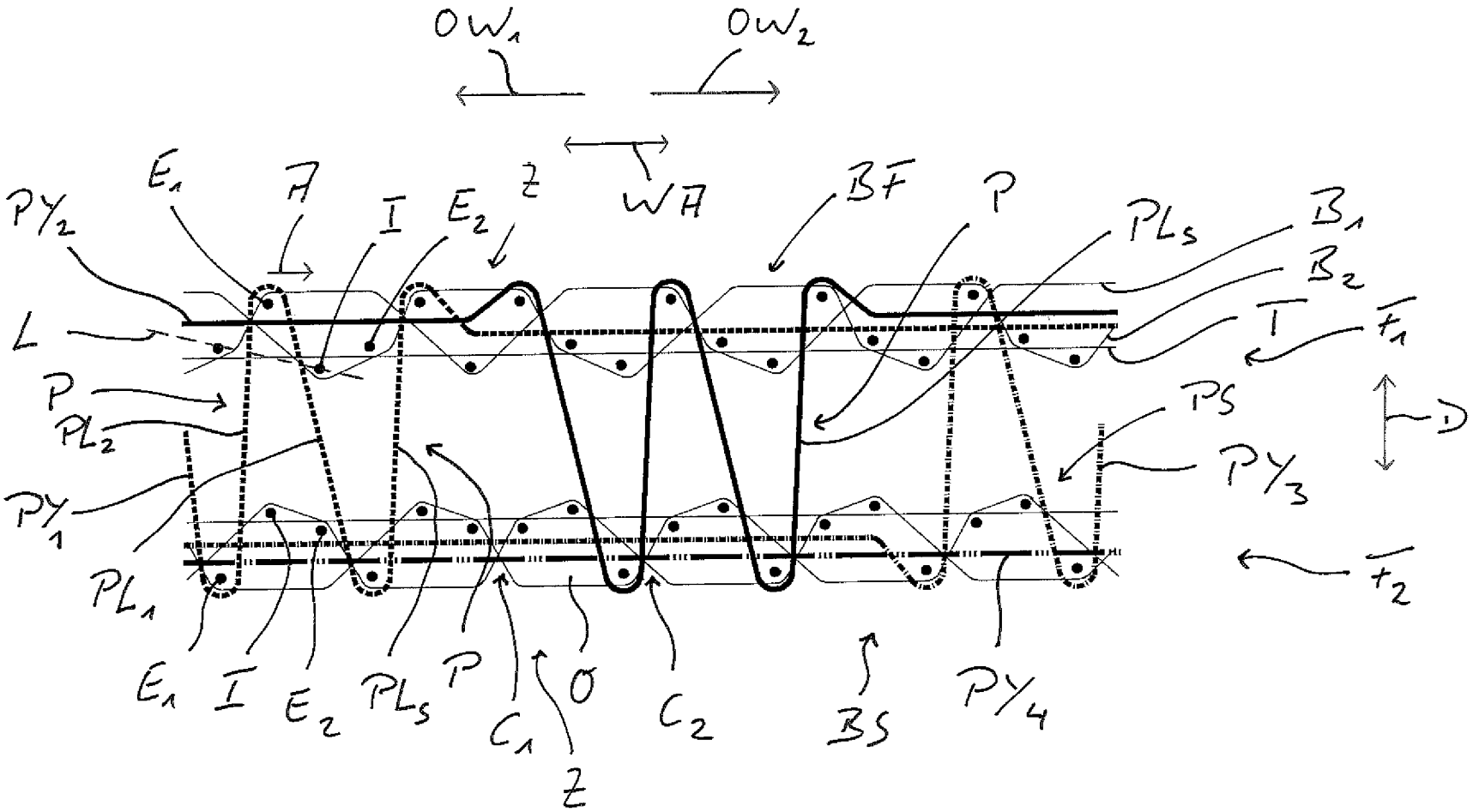
FIG. 1 is a view of a fabric cut in the warp direction showing the weaving structure and the relative positioning of the weft yarns and the warp with respect to each other.

FIG. 1 shows as a sectional view the weaving structure of two fabrics $F_1$, $F_2$ commonly woven in a face-to-face weaving method according to the present invention. In particular, FIG. 1 shows the time sequence of the insertion of weft yarns and the interlacing of warp yarns with these weft yarns. In the weaving structure shown in FIG. 1, during each weaving cycle, two weft yarns are inserted simultaneously by means of weft insertion means, for example, rapiers, one being inserted in the top fabric $F_1$ and one being inserted in the bottom fabric $F_2$. As will be explained later on, due to interlacing warp yarns with some of these weft yarns, the weft yarns may become shifted in the warp direction WA, such that in the fabrics $F_1$, $F_2$ the positioning of the weft yarns relative to each other in the warp direction WA may be somewhat different as compared to the positioning shown in FIG. 1.

Each one of the fabrics $F_1$, $F_2$ is constituted by a plurality of warp yarn systems comprising binding warp yarns $B_1$, $B_2$ and tension warp yarns T for providing the ground weave of respective backing fabrics BF as well as pile warp yarns $PY_1$, $PY_2$, $PY_3$, $PY_4$ for providing piles P extending out of the backing fabrics BF on a pile side PS. Each warp yarn system may comprise all the warp yarns for providing a ground weave of the two backing fabrics BF for both fabrics $F_1$, $F_2$ and all the pile warp yarns $PY_1$, $PY_2$, $PY_3$, $PY_4$ interlaced with the weft yarns $E_1$, I, $E_2$ for generating piles P or bound into the backing fabrics BF such as to extend substantially in the warp direction WA as dead pile warp yarns.

When carrying out the face-to-face weaving method of the present invention, one warp yarn system may be associated with each reed dent of a weaving machine. FIG. 1 shows all the warp yarns associated with one such warp yarn system extending through one reed dent of a weaving machine. It is to be noted that not all the warp yarn systems provided in association with the reed dents of a weaving machine must comprise the same number of warp yarns. For example, there may be different numbers of pile warp yarns in different warp yarn systems. Further there may be warp yarn systems comprising all the warp yarns or some of the warp yarns used for generating the backing fabrics BF, and there may be warp yarn systems only comprising pile warp yarns while not comprising the backing warp yarns. Further there may be warp yarn systems which, for example, may comprise the pile warp yarns and the backing warp yarns for one of the two fabrics $F_1$, $F_2$, while in other pile warp yarn systems there may be provided pile warp yarns and the backing warp yarns for the other one of the two fabrics $F_1$, $F_2$ to be woven. However, for providing a uniform weaving structure throughout the entire carpet, it is preferred that at least the major portion of the pile warp yarn systems comprises the same number of warp yarns, in particular comprises all the pile warp yarns and all the backing warp yarns necessary for weaving the two fabrics $F_1$, $F_2$.

It is to be noted that, in the sense of the present invention the cooperation of pile warp yarns with weft yarns extending through weft receiving openings defined by binding warp yarns, while other pile warp yarns and tension warp yarns extend within a respective backing fabric refers to warp yarns extending in close proximity to each other in the weft direction, preferably refers to warp yarns of one and the same warp yarn system.

In the weaving structure shown in FIG. 1, in each one of the backing fabrics BF of the fabrics $F_1$, $F_2$ to be woven, the binding warp yarns $B_1$, $B_2$ repeatedly cross each other at crossings $C_1$, $C_2$ such that, between each pair of crossings $C_1$, $C_2$ following each other in the warp direction WA, a weft receiving opening O is provided through which a plurality of weft yarns extend. In the example shown in FIG. 1, three weft yarns $E_1$, I, $E_2$ extend through each weft receiving opening O. The two weft yarns $E_1$, $E_2$ positioned immediately adjacent to a respective one of the crossings $C_1$, $C_2$ between which a weft receiving opening O is defined, are end weft yarns, while the weft yarn I positioned between these end weft yarns $E_1$, $E_2$ is an intermediate weft yarn. Again it is to be noted that through each one of the weft receiving openings O not necessarily the same number of weft yarns extends. There may be weft yarn receiving openings receiving more than three weft yarns.

In the weaving structure of FIG. 1, the intermediate weft yarn I in some of the weft receiving openings O is separated from the end weft yarn $E_1$ in the same weft receiving opening O positioned adjacent to the one of the crossings $C_1$, $C_2$ defining a respective weft receiving opening O in a first orientation $OW_1$ of the warp direction WA by means of the tension warp yarn T and all the dead pile warp yarns bound into the respective backing fabric BF, and is separated from the end weft yarn $E_2$ in the same weft receiving opening O positioned adjacent to the one of the crossings $C_1$, $C_2$ defining this weft receiving opening O in a second orientation $OW_2$ of the warp direction WA by means of the tension warp yarn T only.

In a weft receiving opening O in which a change of the pile forming pile warp yarn occurs, especially if both pile-forming pile warp yarns are bound into the same fabric when not forming piles, both end weft yarns $E_1$, $E_2$ may be positioned on the back side BS relative to all the warp yarns bound into the backing fabric BF, such that all these warp yarns are used as weft separating warp yarns. This can, for example, be seen in the weft receiving opening O of the top fabric $F_1$, where a change from the pile warp yarn $PY_1$ to the pile warp yarn $PY_2$ occurs.

In some of the weft receiving openings O, the end weft yarns $E_1$ positioned adjacent to the crossings $C_1$ defining these weft receiving openings O in the first orientation $OW_1$ are separated from the associated intermediate weft yarns I by means of the tension warp yarn T only and therefore are positioned on the pile side PS with respect to the dead pile warp yarns, while the end weft yarns $E_2$ positioned adjacent to the crossings $C_2$ defining these weft receiving openings O in the second orientation $OW_2$ are separated from the associated intermediate weft yarns I by means of the tension warp yarn T and the dead pile warp yarns and therefore are positioned on the back side BS with respect to the dead pile warp yarns. However, in all the weft receiving openings O, or at least in the major portion of the weft receiving openings O, both end weft yarns $E_1$, $E_2$ are separated from the intermediate weft yarn I by the tension warp yarn T of a respective warp yarn system.

For forming piles P, the pile-forming pile warp yarns are interlaced with one of the two end weft yarns $E_1$, $E_2$ received in the weft receiving openings O. For example, pile warp yarn $PY_1$ is interlaced with the end weft yarns $E_1$ received in the weft receiving openings O on the back side of the tension warp yarn T and the dead pile warp yarns, while pile warp yarn $PY_2$ is interlaced with the end weft yarns $E_2$ received in the weft receiving openings O on the back side of the tension warp yarn T and the dead pile warp yarns, such that, in each weft receiving opening O, a pile-forming pile warp yarn is interlaced with an end weft yarn $E_1$ or $E_2$ positioned at the back side of the tension warp yarn T and all the dead pile warp yarns bound into the backing fabrics BF acting as the weft separating warp yarns. This leads to a structure in which the piles P generated by pile warp yarn $PY_1$ extend out of the backing fabric BF of each one of the two fabrics $F_1$, $F_2$ between the end weft yarn $E_1$ with which they are interlaced and the intermediate weft yarn I of the same weft receiving opening O, and extend out of the backing fabric between the end weft yarns $E_1$ with which they are interlaced and the immediately adjacent end weft yarn $E_2$ of the weft receiving opening O following in the first orientation $OW_1$ of the warp direction, if such a pile comprises two pile legs $PL_1$, $PL_2$, such that V-piles are provided. If a pile P comprises only one pile leg $PL_s$, which is the case at locations where a pile warp yarn starts or ends forming piles P, this single pile leg $PL_s$ extends out of the backing fabric BF between the end weft yarn $E_1$ with which it is interlaced and the immediately adjacent end weft yarn $E_2$ of the weft receiving opening O following in the first orientation $OW_1$ of the warp direction WA or the intermediate weft yarn I of the weft receiving opening O through which the end weft yarn $E_1$ extends.

Due to the fact that the intermediate weft yarns I are separated from each one of the end weft yarns $E_1$, $E_2$ by at least one weft separating yarn, i.e. the tension warp yarns T and the dead pile warp yarns or the tension warp yarns T only, in each case the piles P extend out of a respective one of the backing fabrics BF between two weft yarns I, $E_2$ positioned adjacent to the weft yarn $E_1$ with which a pile-forming pile warp yarn, for example, $PY_1$, is interlaced. As can be seen in the top fabric $F_1$ of FIG. 1, these two weft yarns I, $E_2$ are positioned along a line L that is inclined with respect to the warp direction WA. Further, due to the force applied by the binding warp yarns $B_1$, $B_2$ to the end weft yarns $E_1$, $E_2$, the end weft yarns with which the pile forming pile warp yarns are interlaced will be shifted towards the intermediate weft yarns I, as shown by an arrow A in FIG. 1. All this will lead to an inclination of the piles P and the pile legs $PL_1$, $PL_2$, respectively, with respect to a direction D that is perpendicular with respect to a plane defined by the warp direction WA and the weft direction, which is perpendicular with respect to the drawing plane of FIG. 1. This means that all the piles P generated by pile warp yarn $PY_1$ will be inclined to the left, such that they extend out of the backing fabrics BF in a direction that may be nearly perpendicular with respect to the line L. Contrary to that, all the piles P generated, for example, by means of pile warp yarn $PY_2$ will be inclined to the right side in FIG. 1. This inclination and varying inclination, respectively, leads to a shadow effect, such that depending on the viewing angle the carpet will have areas that appear to be brighter and will have areas that appear to be darker.

This shadow effect depends on whether a respective pile-forming pile warp yarn is interlaced with an end weft yarn $E_1$ or is interlaced with an end weft yarn $E_2$ of a respective weft receiving opening O. As can be seen in FIG. 1, for increasing this shadow effect, those weft yarns with which the pile-forming pile warp yarns are interlaced are separated from the intermediate weft yarns I by all the warp yarns extending within a respective backing fabric BF, while those end weft yarns not used for interlacing with a pile-forming pile warp yarn are separated from the intermediate weft yarns I by the tension warp yarns T as the only weft separating yarns.

As stated above, due to the forces applied to the weft yarns by the binding warp yarns and/or applied to the weft yarns during the weaving process, the sequence of the weft yarns in the warp direction and/or the distance of immediately adjacent weft yarns from each other may deviate from the ones shown in the drawings. The sequence of the weft yarns in the drawings corresponds to the sequence with which the weft yarns are introduced during the weaving process by weft insertion means. For example, for each one of the weft receiving openings, an end weft yarn, and intermediate weft yarn, and a further end weft yarn may be introduced one after the other for each one of the two fabrics. Due to the above stated forces applied to the weft yarns in the warp direction, in particular applied to the weft yarns not used for interlacing pile warp yarns, these weft yarns may become shifted in the warp direction, such that, for example, an intermediate weft yarn is closer to a crossing of two binding warp yarns than the one end weft yarn not used for interlacing a pile warp yarn (in a particular warp yarn system) which, when introducing this weft yarn, was closer to this crossing than the intermediate weft yarn. This can lead to a situation in which, in some of the weft receiving openings, in association with some of the warp yarn systems the sequence of the weft yarns in the warp direction is such that a weft yarn used for interlacing a pile warp yarn and being positioned immediately adjacent to a crossing of the two binding warp yarns of a respective warp yarn system is followed by the other end weft yarn not used for interlacing a pile warp yarn and then the intermediate weft yarn, i.e. the weft yarn which is separated from the end weft yarns by means of at least one weft separating warp yarn, preferably comprising at least the tension warp yarn(s) of a respective warp yarn system. Further there may be situation, in which two weft yarns not used for interlacing pile warp yarns, for example, comprising an intermediate weft yarn and an end weft yarn, due to the forces applied thereto, are positioned substantially one above the other in the direction D. However, it is to be expected that, in the major portion of the weft receiving openings, the sequence of the weft yarns corresponds to the sequence with which the weft yarns are introduced into the backing fabrics during the weaving process In an alternative weaving structure shown in FIG. 2, in each weft receiving opening O, both end weft yarns $E_1$, E2 of a respective weft receiving opening O are separated from the intermediate weft yarn I of this weft receiving opening by all the warp yarns extending within a respective backing fabric BF in the area of this weft receiving opening and therefore providing weft separating warp yarns. This leads to an increased angle of inclination of the line L defining the positioning of a gap between two weft yarns between which a respective pile P extends out of the backing fabric BF on the pile side PS.

For providing a symmetrical structure in both fabrics $F_1$, $F_2$, the crossings $C_1$, $C_2$ of the top fabric F1 are offset with respect to the crossings $C_1$, $C_2$ of the bottom fabric $F_2$ in the warp direction. This leads to a corresponding offset of the weft receiving openings O and the weft yarns received in these weft receiving openings O, in particular the end weft yarns $E_1$, $E_2$ with which the pile-forming pile warp yarns are interlaced. When looking at the first pile P generated by means of the pile warp yarn $PY_1$ in the bottom fabric $F_2$, i.e. the pile P positioned on the left most side of FIG. 1, it can be seen that this pile is interlaced with the end weft yarn $E_1$ of the first weft receiving opening O of the bottom fabric $F_2$ shown on the left most side in FIG. 1. The first pile P of the top fabric $F_1$ generated by using pile warp yarn $PY_1$ is generated during the next weaving cycle by interlacing this pile warp yarn $PY_1$ with the end weft yarn inserted in this next weaving cycle into the top fabric $F_1$, which end weft yarn again is a first end weft yarn $E_1$. Due to this offset of the first end weft yarns $E_1$ of the top fabric $F_1$ to the first end weft yarns $E_1$ of the bottom fabric $F_2$, the piles generated by the same pile warp yarn in consecutive weaving cycles will have the same direction of inclination in both fabrics $F_1$, $F_2$. Of course, this offset of one weft insertion cycle leads to the same structure of the piles generated by interlacing a corresponding pile warp yarn with the second end weft yarns $E_2$ of the two fabrics $F_1$, $F_2$.

While the crossings $C_1$, $C_2$ of the two fabrics $F_1$, $F_2$ preferably are shifted with respect to each other in the warp direction WA, for example, by one weft yarn, i.e. one weaving cycle, the crossings $C_1$, $C_2$ of different warp yarn systems following each other in the weft direction within each one of the two fabrics $F_1$, $F_2$ preferably are positioned at the same location in the warp direction WA. This leads to lines of crossings $C_1$ and lines of crossings $C_2$ within each one of the two fabrics $F_1$, $F_2$ extending substantially in the weft direction.

Figure 2:
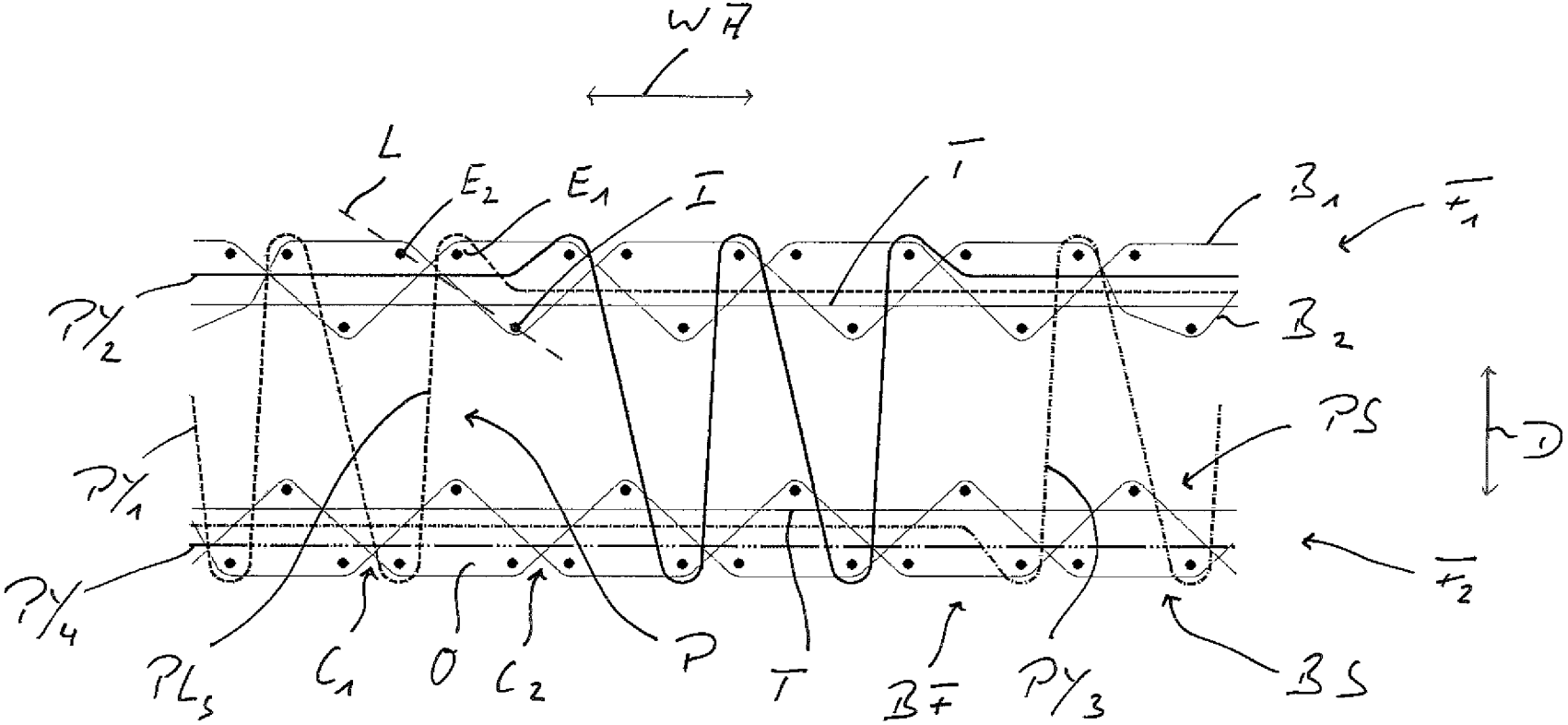
FIG. 2 is a view corresponding to the view of FIG. 1 showing another embodiment of a weaving structure.

By providing the weaving structure shown in FIG. 1 and in FIG. 2 and by using a weaving method as explained above for obtaining such weaving structures, the tension warp yarns provided in association with the various warp yarn systems and provided in association with the two fabrics to be woven need not be moved by means of a jacquard machine for forming a shed, but can be moved by the same means as used for moving the other warp yarns of the backing fabrics, i.e. the binding warp yarns. For example, heald frames may be used for moving all the warp yarns provided for generating the ground weave of the backing fabrics, while a jacquard machine may be used for moving the pile warp yarns.

What becomes clear from the above explanation of the embodiments shown in FIGS. 1 and 2 is that the selection of the direction of inclination of the piles is made by selecting the positioning of an end weft yarn used for interlacing with a pile warp yarn either immediately adjacent to the one or immediately adjacent to the other one of the crossings of the binding warp yarns defining a respective weft receiving opening. The weaving structure, i.e. the ground weave, of the respective backing fabrics remains unchanged preferably throughout an entire fabric. This ground weave is defined by the relative positioning of the weft yarns with respect to the other yarns of the ground weave of the backing fabrics, i.e. the tension warp yarns and the binding warp yarns. The two end weft yarns will always be separated from the intermediate weft yarn of a respective weft receiving opening by at least one tension warp yarn and will not be separated from each other in the direction D by such a tension yarn. Due to this quite simple and constant weaving structure, there is no need for using a jacquard machine for moving the tension warp yarns during the weaving process.

It is to be noted that in a fabric according to the present invention, more than one intermediate weft yarn may be used in the various weft receiving openings. In each case, in line with the principles of the present invention, a pile or a pile leg of a pile, respectively, will extend out of the backing fabric on the pile side between the weft yarn with which it is interlaced and an intermediate weft yarn of the same weft receiving opening. Further there may be additional weft yarns positioned on the back side relative to one or a plurality of weft separating warp yarns, which additional weft yarns may be positioned between the two end weft yarns of a respective weft receiving opening. In addition to interlacing the pile warp yarns with one of the end weft yarns, the pile warp yarns may be interlaced with such an additional weft yarn, such as to be interlaced with two adjacent weft yarns of the same weft receiving opening, one of these weft yarns being an end weft yarn. Further, when weaving such a structure as shown in the drawings, additional steps known to the man skilled in the art will have to be carried out. For example, when weaving these structures in a face-to-face weaving process, one of the last measures will be the cutting of the piles connecting the two fabrics with each other, such that the two separated fabrics will be obtained.

Figure 3:
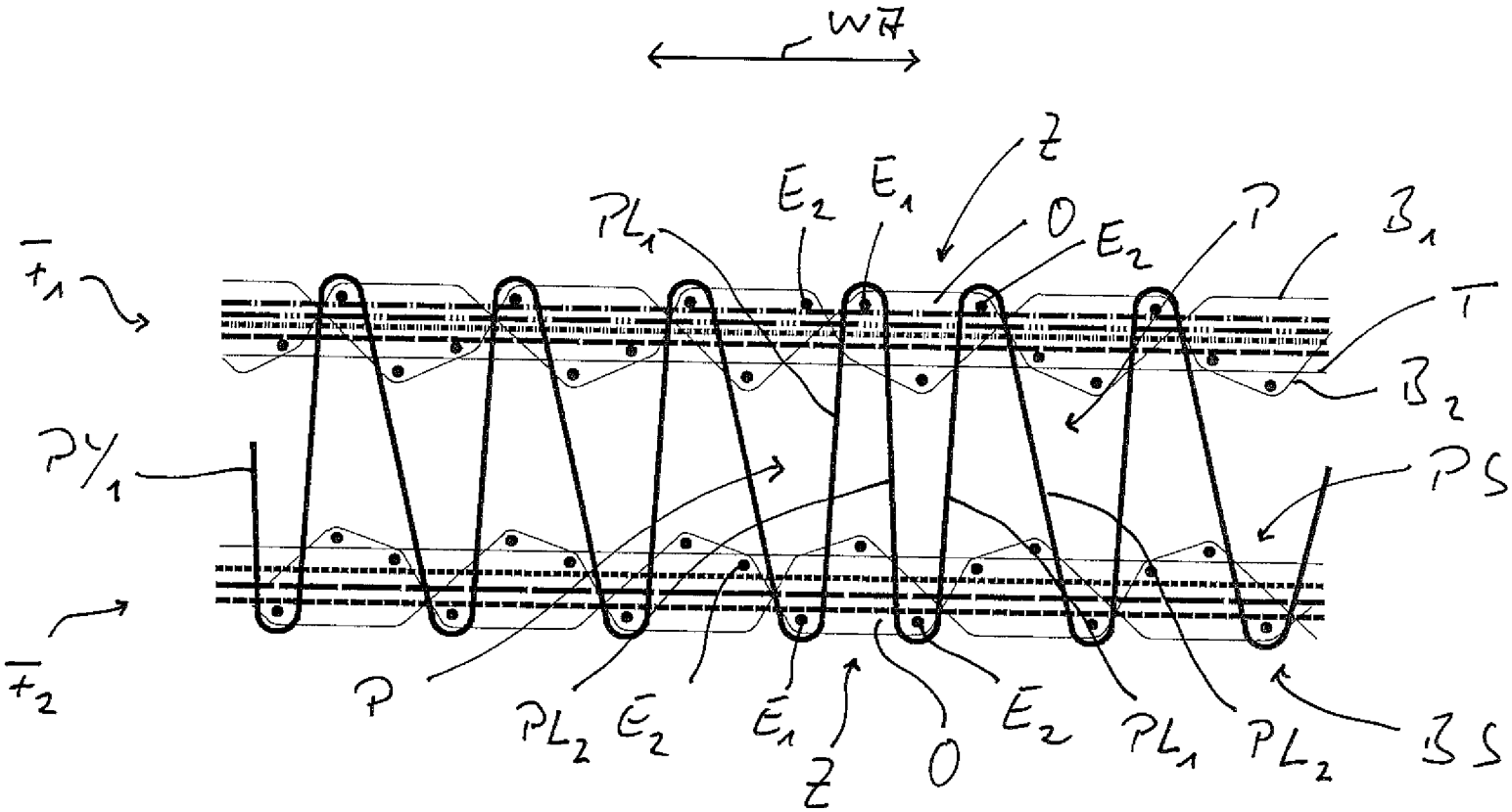
FIG. 3 is a view corresponding to FIG. 1 showing a change of the inclination of the piles provided by the same pile warp yarn.

A further embodiment of a fabric and a method of weaving fabric, respectively, is shown in FIG. 3. In this embodiment, again, there are transition zones Z in the two fabrics $F_1$, $F_2$ where a change of the inclination of the piles P provided in each one of the two fabrics $F_1$, $F_2$ occurs.

Contrary to the transition zones Z of FIG. 1, in which not only the direction of inclination of the piles P but additionally the pile forming pile warp yarn is changed, in the transition zones Z of the embodiment shown in FIG. 3 only the direction of inclination of the piles P is changed.

In the transition zones Z of this embodiment, there is provided a weft receiving opening O in which both end weft yarns $E_1$, $E_2$ are used for interlacing the pile forming pile warp yarn $PY_1$. Both end weft yarns $E_1$, $E_2$ of these weft receiving openings O are on the back side BS relative to the associated tension warp yarns T and relative to the dead pile warp yarns bound into the respective fabrics $F_1$, $F_2$ (four in the top fabric $F_1$ and three in the bottom fabric $F_2$). In this a weaving structure, in each one of the two fabrics $F_1$, $F_2$, in association with the respective weft receiving openings O, two piles P, each pile P comprising two pile legs $PL_1$, $PL_2$ are provided. This leads to an increased pile density in the area of this transition zones Z and avoids the occurrence of a pile gap in these transition zones Z.

As shown in association with the top fabric $F_1$, the immediately adjacent end weft yarn $E_2$ of at least one weft receiving opening O positioned immediately adjacent to the weft receiving opening O of the transition zone Z and not used for interlacing with a pile-forming pile warp yarn may be positioned at the back side BS relative to the tension warp yarn T and the dead pile warp yarn $PY_2$ bound into this fabric, such as to be on the same level as the immediately adjacent end weft yarn $E_1$ of the transition zone Z. However, as shown on the right side of the top fabric $F_1$ and as shown on both sides of the transition zone Z of the bottom fabric $F_2$, the immediately adjacent end weft yarn of at least one immediately adjacent weft receiving opening O may be positioned on the pile side PS relative to the dead pile warp yarns and on the back side BS relative to the tension warp yarns T, such that only the tension warp yarns T are used as weft separating warp yarns between this immediately adjacent end weft yarn and the intermediate weft yarn of the weft receiving opening O and in these areas.

The invention claimed is:

1. Fabric having a shadow effect, comprising:

a backing fabric having binding warp yarns repeatedly crossing each other for providing weft receiving openings, tension warp yarns substantially extending in a warp direction, and weft yarns substantially extending in a weft direction through the weft receiving openings, pile warp yarns interlaced with weft yarns of the backing fabric for providing piles extending out of the backing fabric at a pile side, wherein, in at least one weft receiving opening, at least one weft yarn positioned immediately adjacent to one of the crossings of the binding warp yarns defining this weft receiving opening in the warp direction provides an end weft yarn positioned at a back side relative to at least one weft separating warp yarn extending in the backing fabric substantially in the warp direction, and at least one intermediate weft yarn positioned adjacent to such an end weft yarn in the warp direction is positioned at the pile side relative to the at least one weft separating warp yarn, wherein, for providing a pile, in association with this weft receiving opening, a pile warp yarn is interlaced with an end weft yarn of this weft receiving opening such as to extend out of the backing fabric between this end weft yarn and an intermediate weft yarn of this weft receiving opening.

2. The fabric according to claim 1, wherein at least one pile comprises two pile legs, one of the pile legs extending out of the backing fabric between the end weft yarn and the intermediate weft yarn and the other pile leg extending out of the backing fabric between the end weft yarn and an end weft yarn of an immediately adjacent weft receiving opening, and/or wherein at least one pile comprises a single pile leg extending out of the backing fabric between the end weft yarn and the intermediate weft yarn, and/or wherein at least one pile comprises a single pile leg extending out of the backing fabric between the end weft yarn and an end weft yarn of an immediately adjacent weft receiving opening.

3. The fabric according to claim 1, wherein in association with at least one weft receiving opening a pile is provided by interlacing a pile warp yarn with an end weft yarn of this weft receiving opening positioned immediately adjacent to the crossing of the binding warp yarns defining this weft receiving opening in a first orientation of the warp direction and, in association with at least one other weft receiving opening, a pile is provided by interlacing a pile warp yarn with an end weft yarn of this weft receiving opening positioned immediately adjacent to the crossing of the binding warp yarns defining this weft receiving opening in a second orientation of the warp direction, and/or wherein in association with at least one weft receiving opening only one pile is provided.

4. The fabric according to claim 1, wherein pile warp yarns not used for forming piles are bound into the backing fabric such as to extend substantially in the warp direction as dead pile warp yarns, and wherein at least one intermediate weft yarn of at least one weft receiving opening is separated from both end weft yarns of this weft receiving opening by at least one tension warp yarn and at least one of the dead pile warp yarns extending in the area of this weft receiving opening.

5. The fabric according to claim 1, wherein pile warp yarns not used for forming piles are bound into the backing fabric such as to extend substantially in the warp direction as dead pile warp yarns, and wherein at least one of at least one weft receiving opening is separated from a first one of the two end weft yarns of this weft receiving opening only by at least one tension warp yarn and is separated from the second one of the two end weft yarns of this weft receiving opening by at least one tension warp yarn and at least one of the dead pile warp yarns extending in the area of this weft receiving opening.

6. The fabric according to claim 5, wherein, in association with this weft receiving opening, a pile is formed by interlacing a pile warp yarn with the second one of the two end weft yarns of this weft receiving opening, and/or wherein the first one of the two end weft yarns of this weft receiving opening is arranged on the pile side relative to the dead pile warp yarns extending in the area of this weft receiving opening and the second one of the two end weft yarns of this weft receiving opening is arranged on the back side relative to the dead pile warp yarns extending in the area of this weft receiving opening.

7. The fabric according to claim 1, wherein through at least one weft receiving opening two weft yarns providing the two end weft yarns and one intermediate weft yarn extend substantially in the weft direction, and/or wherein through at least one weft receiving opening three weft yarns extend.

8. The fabric according to claim 1, wherein a plurality of warp yarn systems are provided following each other in the weft direction, at least one warp yarn system comprising two binding warp yarns crossing each other, at least one tension warp yarn, and at least one pile warp yarn, wherein, in the pile warp yarn systems, piles are provided by the pile warp yarns of a respective pile warp yarn system by interlacing these pile warp yarns with weft yarns extending through the weft receiving openings provided by the binding warp yarns of the same pile warp yarn system.

9. The fabric according to claim 1, wherein, in at least one weft receiving opening the two weft yarns positioned immediately adjacent to the two crossings of the binding warp yarns defining this weft receiving opening are not separated by a tension warp yarn.

10. The fabric according to claim 1, wherein, throughout the major portion of the fabric the ground weave of the backing fabric provided by the binding warp yarns, the tension warp yarns, and the weft yarns is the same, and/or the crossings of the binding warp yarns defining the weft receiving openings in the two orientations of the warp direction are located at the same position in the warp direction.

11. The fabric according to claim 1, wherein the fabric is a carpet.

12. Method of weaving a fabric, wherein, for weaving a backing fabric, binding warp yarns are provided crossing each other for providing weft receiving openings, such that each weft receiving opening is defined in the warp direction by two crossings of binding warp yarns, wherein tension warp yarns are provided extending substantially in the warp direction and in association with at least one weft receiving opening, weft yarns are provided extending through this weft receiving opening substantially in the weft direction, such that the weft yarns positioned immediately adjacent to the two crossings defining this weft receiving opening in the warp direction are provided as end weft yarns positioned at a back side relative to at least one weft separating warp yarn and at least one intermediate weft yarn positioned substantially between the two end weft yarns in the warp direction is positioned at a pile side relative to the at least one weft separating warp yarn, wherein, in association with this weft receiving opening, a pile is generated by interlacing a pile warp yarn with one of the end weft yarns of this weft receiving opening such as to extend out of the backing fabric at the pile side between this end weft yarn and an intermediate weft yarn of this weft receiving opening.

13. The method according to claim 12, wherein pile warp yarns not used for forming piles are bound into the backing fabric such as to extend substantially in the warp direction as dead pile warp yarns, and wherein at least one intermediate weft yarn of at least one weft receiving opening is separated from both end weft yarns of this weft receiving opening by at least one tension warp yarn and at least one of the dead pile yarns extending in the area of this weft receiving opening.

14. The method according to claim 12, wherein pile warp yarns not used for forming piles are bound into the backing fabric such as to extend substantially in the warp direction as dead pile warp yarns, and wherein at least one intermediate weft yarn of at least one weft receiving opening is separated from a first one of the two end weft yarns of this weft receiving opening only by at least one tension warp yarn and is separated from the second one of the two end weft yarns of this weft receiving opening by at least one tension warp yarn and at least one of the dead pile yarns extending in the area of this weft receiving opening.

15. The method according to claim 12, wherein, in association with each fabric to be woven, a plurality of warp yarn systems is provided following each other in the weft direction, at least one warp yarn system comprising two binding warp yarns crossing each other, at least one tension warp yarn, and at least one of the pile warp yarns, wherein, in the pile warp yarn systems, piles are provided by the pile warp yarns of a respective pile warp yarn system by interlacing these pile warp yarns with weft yarns extending through the weft receiving openings provided by the binding warp yarns of the same pile warp yarn system.

16. The method according to claim 15, wherein, in association with at least one reed dent of a weaving machine, at least one warp yarn system is provided.

17. The method according to claim 12, wherein the method is a face-to-face weaving method for simultaneously weaving two fabrics.

18. The method according to claim 17, wherein, in association with each fabric to be woven, a plurality of warp yarn systems is provided following each other in the weft direction, at least one warp yarn system comprising two binding warp yarns crossing each other, at least one tension warp yarn, and at least one of the pile warp yarns, wherein, in the pile warp yarn systems, piles are provided by the pile warp yarns of a respective pile warp yarn system by interlacing these pile warp yarns with weft yarns extending through the weft receiving openings provided by the binding warp yarns of the same pile warp yarn system, wherein at least one, warp yarn system comprises the warp yarns for both fabrics to be woven.

19. The method according to claim 18, wherein, in association with at least one warp yarn system, the crossings of the binding warp yarns of one of the two fabrics to be woven are offset relative to the crossings of the binding warp yarns of the other one of the fabrics to be woven in the warp direction.

20. The method according to claim 12, wherein, in at least one fabric the crossings of the binding warp yarns defining the weft receiving openings in the two orientations of the warp direction are located at the same position in the warp direction.

* * * * *